US005256475A

United States Patent [19]

Koyanagi et al.

[11] Patent Number: 5,256,475

[45] Date of Patent: Oct. 26, 1993

[54] FABRIC FOR FIBER-REINFORCED THERMOPLASTIC COMPOSITE MATERIAL

[76] Inventors: Ryota Koyanagi; Mikiya Fujii, both of 2-2, Aza-Hino, Toyano, Fukushima-shi, Fukushima, Japan; Shoichi Watanabe, 67-14-44, Hourai-cho, Fukushima-shi, Fukushima, Japan; Hirokazu Inoguchi, 57-9, Hourai-cho, Fukushima-shi, Fukushima, Japan

[21] Appl. No.: 967,821

[22] Filed: Oct. 28, 1992

[30] Foreign Application Priority Data

Oct. 31, 1991 [JP] Japan ..... 3-311339

[51] Int. Cl.[5] ..... D03D 3/00

[52] U.S. Cl. ..... 428/225; 139/420 A; 428/257; 428/258; 428/259; 428/902

[58] Field of Search ..... 428/225, 257, 258, 259, 428/902; 139/420 A

[56] References Cited

U.S. PATENT DOCUMENTS

| | | | |
|---|---|---|---|
| 4,360,630 | 11/1982 | Smith | 524/592 |
| 4,820,571 | 4/1989 | Searfass | 428/259 |
| 5,206,078 | 4/1993 | Inoguchi et al. | 428/901 |

FOREIGN PATENT DOCUMENTS

| | | |
|---|---|---|
| 59-2709 | 1/1984 | Japan . |
| 135101 | 7/1989 | Japan . |
| 4249152 | 9/1992 | Japan . |

*Primary Examiner*—James J. Bell

*Attorney, Agent, or Firm*—Dominik, Stein, Saccocio, Reese, Colitz & Van Der Wall

[57] ABSTRACT

A fabric for a fiber-reinforced thermoplastic composite material is disclosed, which comprises the warp and the weft wherein the warp comprises reinforcing fiber and the weft comprises high molecular weight grade polyether ether ketone resin yarns and low molecular weight grade polyether ether ketone resin yarns, or wherein the warp comprises reinforcing fiber and at least one of high molecular weight grade polyether ether ketone resin yarns and low molecular weight grade polyether ether ketone resin yarns and the weft comprises reinforcing fiber and at least one of high molecular weight grade polyether ether ketone resin yarns and low molecular weight grade polyethe ether ketone resin yarns. The fabric can be laminated or molded into a product having an excellent toughness and shock resistance in almost the same heating time as the conventional one.

17 Claims, 1 Drawing Sheet

FABRIC FOR FIBER-REINFORCED THERMOPLASTIC COMPOSITE MATERIAL

FIELD OF THE INVENTION

The present invention relates to fabrics for fiber-reinforced thermoplastic composite materials which are used as materials for framing or housing of motorcars, machine parts, etc.

BACKGROUND OF THE INVENTION

Hitherto, as fabrics for fiber-reinforced thermoplastic composite materials, a hybrid fabric of reinforcing fibers and thermoplastic resin fibers is known as described in JP-B-1-35101 (the term "JP-B" as used herein means an "examined published Japanese patent application"). The hybrid fabric has an advantage that the hybrid fabric is likely to be placed along a mold in the case of molding material which has complicated curved surface owing to the good flexibility for handling but has disadvantages that the toughness of the hybrid fabric itself is yet insufficient as industrial materials and also the laminate of them is inferior in shock resistance.

As a method of overcoming the disadvantages, it can be easily anticipated by a person skilled in the art to increase the molecular weight of the thermoplastic resin. However, using a thermoplastic resin having a high molecular weight is reluctant because it is too hard to form fibers for its excessively high viscosity and also because the low impregnating property to the fabric is liable to reduce the quality of the appearance of the molded product, such a thermoplastic resin is reluctant to be used for composite materials. This means that if a thermoplastic resin having a high molecular weight is intended to dare to use as it is, without any special treatment, a high heating temperature and a long heating time are needed, or the quality of the appearance of the moldings is reduced, whereby the use of such a thermoplastic resin is not preferable for the production of industrial materials.

SUMMARY OF THE INVENTION

The object of the present invention is to provide a hybrid fabric made out of reinforcing fibers and thermoplastic fibers, which can be molded into a laminate or other articles having an excellent toughness and shock resistance, at a heating temperature and a heating time which are almost the same as the conventional one.

As the result of various investigations for achieving the foregoing object, the inventors have discovered that the foregoing object can be achieved by using a yarn originated from a resin having a high molecular weight and a yarn originated from a resin having a low molecular weight together for the yarn of thermoplastic resin fibers, for the hybrid fabric made out of reinforcing fibers and thermoplastic resin fibers.

That is, according to the first aspect of the present invention, there is provided a fabric for a fiber-reinforced thermoplastic composite material, comprising the warp and the weft, wherein said the warp comprises reinforcing fiber and the said weft comprises high molecular weight grade polyether ether ketone resin yarns and low molecular weight grade polyether ether ketone resin yarns.

Also, according to the second aspect of the present invention, there is further provided a fabric for a fiber-reinforced thermoplastic composite material which has both high and low molecular weight grade polyether ether ketone resin comprising the warp and the weft, wherein the said warp comprises reinforcing fiber and the at least one of high molecular weight grade polyether ether ketone resin yarns and low molecular weight grade polyether ether ketone resin yarns and the said weft also comprises reinforcing fiber and at least one of high molecular weight grade polyether ether ketone resin yarns and low molecular weight grade polyether ether ketone resin yarns, which are not contained in the said warp.

DETAILED DESCRIPTION OF THE INVENTION

Figure 1:
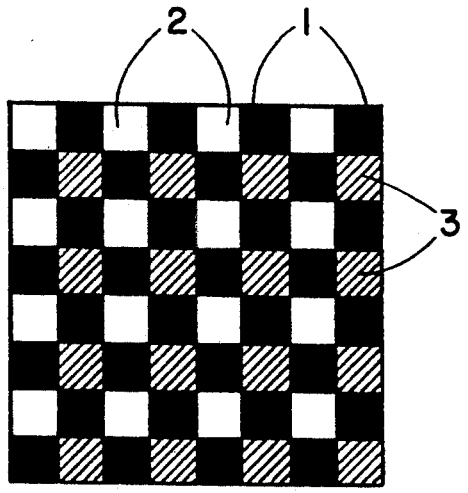
FIG. 1 is a view showing the textile design of a fabric formed by alternately threading high molecular weight grade resin yarns and low molecular weight grade resin yarns of the weft at 1 : 1.

Then, the fabric of the present invention is described in detail.

As the reinforcing fibers being used in the present invention, reinforcing continuous fiber materials such as glass fibers, carbon fibers, aramide fibers, etc., are used and, in particular, yarn-form fibers are preferably used. There are no particular restrictions on the diameter and the filament count of the tow, but the diameter of the filaments is preferably from 5 μm to 13 μm and the filament count is preferably from 500 to 12,000 and more preferably from 500 to 6,000. Also, in regard to the surface treatment of the reinforcing fibers, any surface treatment agent which does not hinder the adhesion with polyether ether ketone can be used.

As the polyether ether ketone resin yarns being used in this invention, high molecular weight grade polyether ether ketone resin yarns (hereinafter, referred to as high molecuar weight grade yarns) and low molecular weight grade polyether ether ketone resin yarns (hereinafter, referred to as low molecular weight grade yarns) are used together. The high molecular weight grade yarns are those having a viscosity of at least $1.3\times10^4$ poises at 360° C. and have a mean molecular weight of 70,000 or more, preferably from 80,000 to 300,000. The low molecular weight grade yarns are those having a viscosity lower than $1.3\times10^4$ and have mean molecular weight of not more than 70,000, preferably from 15,000 to 70,000. The viscosity of the resins in the present invention is measured under a load of 30 kg/cm$^2$ using a die having a diameter of 0.5 mm and a length of 1.0 mm. The diameter of the filaments is preferably from 30 μm to 60 μm (more preferably from 50 to 60 μm) for the high molecular weight grade yarns and from 30 μm to 40 μm for the low molecular weight grade yarns, and the filament count is preferably from 12 to 100 (more preferably from 12 to 48) for the high molecular weight grade yarns and from 48 to 100 for the low molecular weight grade yarns. The yarn count of the low molecular weight grade yarn or the high molecular weight grade yarn is preferably from 38 to 200 tex. The polyether ether ketone resin for yarns used in the present invention preferably comprises the following skeleton of 50 mol% or more, more preferably 80 mol% or more:

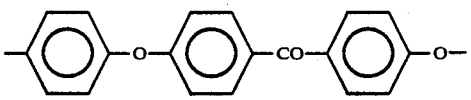

When both the high molecular weight grade yarns and the low molecular weight grade yarns are used, the ratio of the number of former yarns to latter yarns in a woven fabric is preferably in the range of from 3/1 to 1/3. If the ratio of the high molecular weight grad yarns is higher than the foregoing range, the inconveniences of an inferior impregnating property and the occurrence of resin masses tends to occur and if the ratio of the low molecular weight grade yarns is higher than the foregoing range, the inconvenience of lowering the toughness tends to occur. The ratio by weight of the high molecular weight grade yarns to the low molecular weight grade yarns to be used in the fabric of the present invention is generally from 10:90 to 90:10 and preferably from 30:70 to 70:30.

The concept of the polyether ether ketone resin yarns in the present invention includes not only the high molecular weight grade yarns and the low molecular weight grade yarns respectively but also plied yarns of the high molecular weight grade yarns and the low molecular weight grade yarns. The plied yarn can be prepared by doubling and twisting the two kinds of yarns. In this case, the yarns of two kinds have different yarn number counts under the condition that the diameter of their filaments and their filament counts satisfy the ranges mentioned above. The ratio of the doubling and twisting counts of them can be selected in the range of from 3/1 to 1/3.

The thread count of the warp is preferably from 15 threads/25 mm to 45 threads/25 mm as the yarn count.

When the reinforcing fiber is used together with the resin yarns (including resin plied yarns) as the warp, it is preferred that the reinforcing fiber and the resin yarn are alternately arranged in a same number, but the ratio of the numbers of the reinforcing fiber to the resin yarn can be imbalanced in the range of from 2/1 to 1/2.

In regard to the resin yarns for the warp, when only one of either of the high molecular weight grade yarns and the low molecular weight grade yarns is used together with reinforcing fiber yarns for the weft, the warp may comprise only one of the two grades of yarns which is not used for the weft, together with reinforcing fiber yarns. Furthermore, in the case of using both the high molecular weight grade yarns and the low molecular weight grade yarns for the warp together with the reinforcing fiber yarns, the ratio of the numbers of the high molecular weight grade yarns and the low molecular weight grade yarns can be imbalanced in the range of from 2/1 to 1/2.

The thread count of the weft is generaly from about 12 threads/25 mm to 28 threads/25 mm and preferably from 15 threads/25 mm to 25 threads/25 mm, as the yarn count. This is same in the case that resin yarns only are used as the weft and the high molecular weight grade yarns and the low molecular weight grade yarns are alternately threaded, the case that they are plied yarns, and the case that the reinforcing fiber are used together with resin yarns or the plied yarns thereof are used.

When the reinforcing fiber is used together as the weft with the resin yarns or the resin plied yarns, it is preferable that both the yarns are alternately arranage in a same number but the numbers of the yarns can be imbalanced in the range of from 2/1 to 1/2.

In regard to the resin yarns for the weft, when only one of either of the high molecular weight grade yarns or the low molecular weight grade yarns is used together with reinforcing fiber for the warp, the weft may comprise only one of the two grades of yarns which is not used for the warp, together with reinforcing fiber. Furthermore, in the case of using both the high molecular weight grade yarns and the low molecular weight grade yarns for the weft together with the reinforcing fiber, the ratio of the numbers of the high molecular weight grade yarns and the low molecular weight grade yarns can be imbalanced in the range of from 2/1 to 1/2.

The combinations of the use and arrangement of the yarns for the warp and the weft of the fabric of the present invention are summarized as follows.

(1) The reinforcing fiber is used for the warp and the high molecular weight grade polyether ether ketone resin yarns and the low molecular weight grade polyether ether ketone resin yarns are used for the weft.

(2) The reinforcing fiber, the high molecular weight grade polyether ether ketone resin yarns, and the low molecular weight grade polyether ether ketone resin yarns are used for the warp, and the reinforcing fiber, the high molecular weight grade polyether ether ketone resin yarns, and the low molecular weight grade polyether ether ketone resin yarns are used for the weft.

(3) The reinforcing fiber, the high molecular weight grade polyether ether ketone resin yarns, and the low molecular weight grade polyether ether ketone resin yarns are used for the warp, and the reinforcing fiber and the high molecular weight grade polyether ether ketone resin yarns are used for the weft.

(4) The reinforcing fiber, the high molecular weight grade polyether ether ketone resin yarns, and the low molecular weight grade polyether ether ketone resin yarns are used for the warp, and the reinforcing fiber and the low molecular weight grade polyether ether ketone resin yarns are used for the weft.

(5) The reinforcing fiber and the high molecular weight grade polyether ether ketone resin yarns are used for the warp, and the reinforcing fiber, the high molecular weight grade polyether ether ketone resin yarns, and the low molecular weight grade polyether ether ketone resin yarns are used for the weft.

(6) The reinforcing fiber and the high molecular weight grade polyether ether ketone resin yarns are used for the warp, and the reinforcing fiber and the low molecular weight grade polyether ether ketone resin yarns are used for the weft.

(7) The reinforcing fiber and the low molecular weight grade polyether ether ketone resin yarns are used for the warp, and the reinforcing fiber, the high molecular weight grade polyether ether resin yarns, and the low molecular weight grade polyether ether resin yarns are used for the weft.

(8) The reinforcing fiber and the low molecular weight grade polyether ether ketone resin yarns are used for the warp, and the reinforcing fiber and the high molecular weight grade polyether ether ketone resin yarns are used for the weft.

Among the above combinations, (1) is the most preferred.

In each of the foregoing combinations, when both the high molecular weight grade polyether ether ketone resin yarns and the low molecular weight grade polyether ether ketone resin yarns are used for the warp and/or the weft, the plied yarns of both the yarns may be used.

Also, when two or more kinds of yarns each having a different nature are used in the warp and/or the weft, these yarns can be arranged or threaded in the order of alternately one by one, plural by plural, or one by plural.

As a weaving machine for making fabrics, any conventionally known one can be used without any particular restriction. Regardless of the combination of the warp and the weft, a generally employed weaving method, such as a plain weave, a twill weave, a satin weave, a mat weave, etc., may be used, and, for example, an irregular method such as 5HS (Five-harness satin) may be employed.

The content of the reinforcing fibers of the fabric of the present invention is generally from 20 to 70% by weight and preferably from 30 to 70% by weight.

The fabrics of the present invention are mainly used as a laminate formed by laminating the fabrics and treating the laminated fabrics by hot press plates or a hot press roller to melt the resins. The laminate is further molded or formed and used as materials for framing or housing of motorcars, parts of machines, etc. As a matter of course, the laminated fabrics may be directly formed or molded into a three-dimensional structure.

The fabrics of the present invention can be preferably molded at a temperature of from 360° C. to 400° C. and at a pressure of from 10 to 30 kg/cm$^2$.

Now, when the forgoing fabrics of the present invention are laminated and/or heat-press molded, the low molecular weight grade yarns, which are liable to melt and fluid, permeate in the gaps among the reinforcing fibers and the high molecular weight grade yarns. Thus, it can be understood that in the present invention, the heating temperature and the heating time at molding are almost same as those in conventional cases and also the occurrence of an inferior appearnce of the product by inferior impregnating property can be prevented.

Also, some of the high molecular weight grade yarns melt and fluid in the course of heat-press molding but since the original form of the yarns also remains, the fabric structure of the reinforcing fibers and resin yarns is not lost, whereby the laminate molding of the fabrics of the present invention is excellent in the toughness and the shock resistance as compared to those originated from a hybrid fabric composed of conventional reinforcing fibers and thermoplastic resin fibers and also does not reduce the appearance of the product.

Then, the invention is further explained in more detail by the following examples and comparison examples.

Furthermore, the following reference examples show the excellent properties of the laminates of the fabrics of the present invention.

In addition, in the following examples, the polyether ether ketone resin yarns of a grade of Victrex PEEK 380 G or higher are high molecular weight grade polyether ether ketone resin yarns, and those of a grade lower than Victrex PEEK 380G are low molecular weight grade polyether ether ketone resin yarns. The mean molecular weights of Victrex PEEK 150G and 380G used in the following examples were about 60,000 and 81,000, respectively. The measurement of the mean molecular weight was carried out by GPC (gel permeation chromatograpy) method, using SSC-7000 (manufactured by Senshu Scientific Co.) with UV of 360 nm as a detector and 1-chloronaphthalene as an eluent. Torayca T3003K and T300 40B (trade name made by Toray Industries, Inc.) used in the following examples, each are carbon fibers comprising a filament having a diameter of 7 μm and a filament count of 3,000.

EXAMPLE 1

As the warp of the woven fabric, carbon fibers, Torayca T3003K (trade name made by Toray Industries, Inc.) was used and as the weft, Victrex PEEK 150G (trade name, made by Imperial Chemical Industries Limited and so forth) of 150 tex and Victrex PEEK 450K of 150 tex were used. Two kinds of wefts were alternately threaded to the warp and they were plain woven. In the weaving method, as shown in FIG. 1, a system of alternately threading reinforcing fiber yarn 1 as the warf and the low molecular weight grade resin yarn 2 of Victrex PEEK 150G and the high molecular weight grade resin yarn 3 of Victrex PEEK 450G as the weft one by one was employed.

In this case, the yarn count was 20 warps/25 mm and 15 wefts/25 mm.

EXAMPLE 2

By following the same procedure as Example 1 except that the yarns of Victrex PEEK 380G of 150 tex were used in place of the yarns of Victrex PEEK 450G of 150 tex, a fabric was made.

EXAMPLE 3

Figure 2:
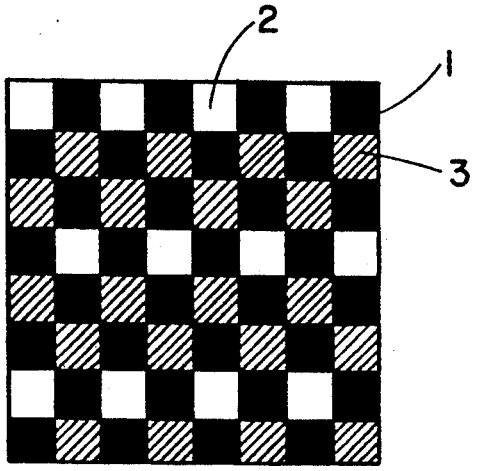
FIG. 2 is a view showing the textile design of a fabric formed by alternately threading high molecular weight grade resin yarns and low molecular weight grade resin yarns of the weft at 2 : 1.

By following the same procedure as Example 1 except that the thread count of the weft was changed such that the yarns of Victrex PEEK 150G were threaded once to threading twice of the yarns of Victrex PEEK 450G, a fabfic was made. In the weaving method, as shown in FIG. 2, the reinforcing fiber yarn 1 was as the warp, the low molecular weight grade resin yarn 2 of Victrex PEEK 150G and the high molecular weight grade resin yarn 3 of Victrex PEEK 450G were used as the weft, and a system of alternately threading one low molecular weight grade resin yarn 2 and two high molecular weight grade resin yarns 3 was employed.

EXAMPLE 4

By following the same procedure as Example 3 except that the yarns of Victrex PEEK 380G of 150 tex were used in place of the yarns of Victrex PEEK 450G of 150 tex, a fabric was made.

EXAMPLE 5

Figure 3:
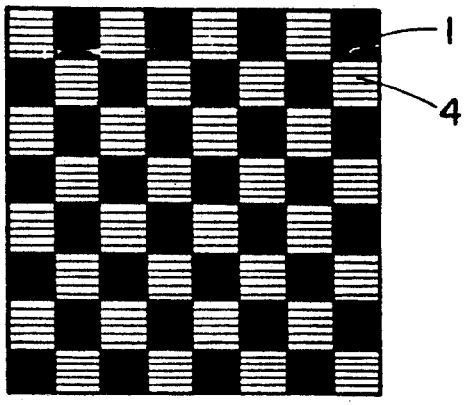
FIG. 3 is a view showing the textile design of a fabric wherein the wefts are formed by doubling and twisting high molecular weight grade resin yarns and low molecular weight grade resin yarns.

As the warp of the woven fabric, carbon fibers, Torayca T3003K (trade name, made by Toray Industries, Inc.) were used, and as the weft, the 1 : 1 plied yarns (150 tex) of Victrex PEEK 150G (75 tex) and Victrex PEEK 450G (75tex) were used. The weft was alternately threaded to the warp, and they were plain woven. In the weaving method, as shown in FIG. 3, a system of using the reinforcing fiber yarns 1 as the warp and threading the plied yarns 4 of the high molecular weight grade resin yarns of Victrex PEEK 450G and the low molecular weight grade resin yarns of Victrex PEEK 150G as the weft was employed.

In this case, the yarn count was 20 warps/25 mm and 15 wefts/25 mm.

EXAMPLE 6

By following the same procedure as Example 5 except that the plied yarns made of yarns of Victrex PEEK 450G of 38 tex and yarns of Victrex PEEK 150G of 112 tex were used as the weft and the yarn count of the weft was 15 wefts/25 mm, a fabric was made.

EXAMPLE 7

As the warp of the woven fabric, the carbon fibers, Torayca T300 40B (trade name, made by Toray Industries, Inc.) and Victrex PEEK 450G of 100 tex were used, and they were alternately subjected to warping. As the weft, the carbon fibers, Torayca T300 40B and Victrex PEEK 150G of 150 tex were used. Two kinds of the wefts were alternately threaded into the warps. The fabric was 5HS, that is, a weaving method that at threading the wefts, one weft was threaded by skipping four warps was employed.

In this case, the yarn count was 25 warps/25 mm and 25 wefts/25 mm.

COMPARISON EXAMPLE 1

As the warp of the woven fabric, the carbon fibers, Torayca T3003K were used and as the weft, yarns of Victrex PEEK 150G of 150 tex were used. The weaving method was a plain weave.

In this case, the yarn count was 20 warps/25 mm and 15 wefts/25 mm.

COMPARISON EXAMPLE 2

By following the same procedure as Comparison Example 1 except that the yarns of Victrex PEEK 450G of 150 used in place of the yarns of Victrex PEEK 150G of 150 tex, a fabric was made.

Then, the measured values of the toughness and the shock resistance of each laminate of the fabrics prepared in foregoing Examples 1 to 6 and Comparison Examples 1 and 2 formed in an autoclave are shown in following reference examples. From the results thereof, it can be easily explained that the fabrics of the present invention are excellent as industrial materials.

REFERENCE EXAMPLE 1

By laminating 32 fabrics prepared in each of Examples 1 to 6 arranging the direction of the carbon fibers of the fabrics, and applying a pressure of 14 kg/cm$^2$ to the laminated fabrics at 395° C. for 4 hours, a laminate of 4.6 mm in thickness was obtained.

From the laminate, a test piece of 127 mm in length and 12.7 mm in width having the lengthwise direction in the fiber axis direction of the carbon fibers was cut. The shock resistance of the test piece was measured by a Charpy impact strength test of ASTM D256.

Then, from the laminate, a piece of 300 mm in length and 40 mm in width having the lengthwise direction in the fiber axis direction of the carbon fibers was cut, and the toughness value ($G_{IC}$) was measured according to Testing Method for Interlaminar Fracture Toughness of Carbon Fiber Reinforced Plastics (proposal) dated Sep. 1, 1989 (a so-called Double Cantilever Beam method), prepared by Japan High Polymer Center.

Also, the appearance was determined visually and by tactile feeling to confirm the existence of small masses of resin.

The results obtained are shown in Table 1 below.

REFERENCE EXAMPLE 2

By following the same procedure as Reference Example 1 using the fabric obtained in each of Comparison Examples 1 and 2, each laminate was prepared, the shock resistance and the toughness value thereof were measured by the same manners as in Reference Example 1, and also the appearance of each sample was observed. The results obtained are shown in Table 2 below.

TABLE 1

| | Shock Resistance (kg · cm/cm$^2$) | Toughness (J/m$^2$) | Appearance |
|---|---|---|---|
| Example 1 | 125 | 1710 | Slightly good |
| Example 2 | 120 | 1590 | " |
| Example 3 | 128 | 1650 | " |
| Example 4 | 121 | 1550 | " |
| Example 5 | 126 | 1850 | Good |
| Example 6 | 125 | 1400 | Good |

TABLE 2

| | Shock Resistance (kg · cm/cm$^2$) | Toughness (J/m$^2$) | Appearance |
|---|---|---|---|
| Comparison Example 1 | 115 | 1150 | Good |
| Comparison Example 2 | 141 | 1630 | Bad |

In Table 1 and Table 2, the appearance "good" means that there is no problem about the impregnated and dispersed state of resins by both the visual observation and tactile feeling, "slightly good" means that there is no problem by the visual observation but an imbalanced impregnated and dispersion state of resins is found by tactile feeling, and "bad" means that the existence of masses of resins is clearly found by the visual observation.

By comparing the results in Table 1 with the results in Table 2, it can be seen that the laminates prepared using the fabrics of the present invention are excellent in the shock resistance and the toughness as compared with the laminate plate composed of the low molecular weight grade resin alone in Comparison Example 1. Also, the laminate composed on the high molecular weight grade resin alone in Comparison Example 2 showed high numeral values in the shock resistance and toughness tests but the appearance of the laminate was bad.

As described above, the fabric of the present invention has the advantage that it can be easily placed along a mold in the case of forming a complicated curved surface and is a fiber-reinforced thermoplastic composite material which can overcome the weakness of the toughness and the shock resistance of a laminate of a conventional thermoplastic resin series molding materials and has an excellent appearance after molding or laminating.

While the invention has been described in detail with reference to specific embodiments, it will be apparent to one skilled in the art that various changes and modifications can be made to the invention without departing from its spirit and scope.

What is claimed is:

1. A fabric for a fiber-reinforced thermoplastic composite material, said fabric comprising warp and weft, wherein said warp comprises reinforcing fiber and said weft comprises high molecular weight grade polyether ether ketone resin yarns and low molecular weight grade polyether ether ketone resin yarns.

2. A fabric for a fiber-reinforced thermoplastic composite material as claimed in claim 1, wherein said reinforcing fiber is a carbon fiber.

3. A fabric for a fiber-reinforced thermoplastic composite material as claimed in claim 1, wherein the content of said reinforcing fiber in the fabric is 20 to 70% by weight.

4. A fabric for a fiber-reinforced thermoplastic composite material, said fabric comprising warp and weft, wherein said warp comprises reinforcing fiber and at least one of high molecular weight grade polyether ether ketone resin yarns and low molecular weight grade polyether ether ketone resin yarns, and said weft comprises reinforcing fiber and at least the other one of high molecular weight grade polyether ether ketone resin yarns and low molecular weight grade polyether ether ketone resin yarns.

5. A fabric for a fiber-reinforced thermoplastic composite material as claimed in claim 4, wherein said reinforcing fiber is a carbon fiber.

6. A fabric for a fiber-reinforced thermoplastic composite material as claimed in claim 4, wherein the content of said reinforcing fiber in the fabric is 20 to 70% by weight.

7. A fabric for a fiber-reinforced thermoplastic composite material as claimed in claim 1, wherein said weft is comprised of plied yarn comprising high molecular weight grade polyether ether ketone resin yarns and low molecular weight grade polyether ether ketone resin yarns.

8. A fabric for a fiber-reinforced thermoplastic composite material as claimed in claim 4, wherein at least one of said warp and said weft comprises plied yarn comprising high molecular weight grade polyether ether ketone resin yarns and low molecular weight grade polyether ether ketone resin yarns.

9. A fabric for a fiber-reinforced thermoplastic composite material as claimed in claim 4, wherein at least one of said warp and said weft comprises both high molecular weight grade polyether ether ketone resin yarns and low molecular weight grade polyether ether ketone resin yarns.

10. A fabric for a fiber-reinforced thermoplastic composite material as claimed in claim 4, wherein the polyether ether ketone resin yarns of at least one of said warp and said weft comprises only one of high molecular weight grade polyether ether ketone resin yarns and low molecular weight grade polyether ether ketone resin yarns.

11. A fabric for a fiber-reinforced thermoplastic composite material as in claim 4, said fabric comprising warp and weft, wherein said warp comprises reinforcing fiber, high molecular weight grade polyether ether ketone resin yarns and low molecular weight grade polyether ether ketone resin yarns, and said weft comprises reinforcing fiber, high molecular weight grade polyether ether ketone resin yarns and low molecular weight grade polyether ether ketone resin yarns.

12. A fabric for a fiber-reinforced thermoplastic composite material as in claim 4, said fabric comprising warp and weft, wherein said warp comprises reinforcing fiber, high molecular weight grade polyether ether ketone resin yarns and low molecular weight grade polyether ether ketone resin yarns, and said weft comprises reinforcing fiber and high molecular weight grade polyether ether ketone resin yarns.

13. A fabric for a fiber-reinforced thermoplastic composite material as in claim 4, said fabric comprising warp and weft, wherein said warp comprises reinforcing fiber, high molecular weight grade polyether ether ketone resin yarns and low molecular weight grade polyether ether ketone resin yarns, and said weft comprises reinforcing fiber and low molecular weight grade polyether ether ketone resin yarns.

14. A fabric for a fiber-reinforced thermoplastic composite material as in claim 4, said fabric comprising warp and weft, wherein said warp comprises reinforcing fiber and high molecular weight grade polyether ether ketone resin yarns, and said weft comprises reinforcing fiber, high molecular weight grade polyether ether ketone resin yarns and low molecular weight grade polyether ether ketone resin yarns.

15. A fabric for a fiber-reinforced thermoplastic composite material as in claim 4, said fabric comprising warp and weft, wherein said warp comprises reinforcing fiber and high molecular weight grade polyether ether ketone resin yarns, and said weft comprises reinforcing fiber and low molecular weight grade polyether ether ketone resin yarns.

16. A fabric for a fiber-reinforced thermoplastic composite material as in claim 4, said fabric comprising warp and weft, wherein said warp comprises reinforcing fiber and low molecular weight grade polyether ether ketone resin yarns, and said weft comprises reinforcing fiber, high molecular weight grade polyether ether ketone resin yarns and low molecular weight grade polyether ether ketone resin yarns.

17. A fabric for a fiber-reinforced thermoplastic composite material as in claim 4, said fabric comprising warp and weft, wherein said warp comprises reinforcing fiber and low molecular weight grade polyether ether ketone resin yarns, and said weft comprises reinforcing fiber and high molecular weight grade polyether ether ketone resin yarns.

* * * * *

UNITED STATES PATENT AND TRADEMARK OFFICE
CERTIFICATE OF CORRECTION

PATENT NO. : 5,256,475
DATED : October 26, 1993
INVENTOR(S) : Ryota Koyanagi, Mikiya Fujii, Shoici Watanabe and Hirokazu Inoguchi It is certified that error appears in the above—identified patent and that said Letters Patent is hereby corrected as shown below:

Column 3, line 15, delete "grad" and insert --grade--
Column 4, line 5, delete "arranage" and insert --arranged--

Signed and Sealed this
Third Day of May, 1994

Bruce Lehman

*Attest:*

BRUCE LEHMAN

*Commissioner of Patents and Trademarks*

*Attesting Officer*